US006900167B2

(12) United States Patent
Griese et al.

(10) Patent No.: US 6,900,167 B2
(45) Date of Patent: May 31, 2005

(54) SOLID COMPOSITION WITH RHEOLOGY MODIFIER

(75) Inventors: Greg Griese, Hudson, WI (US); Mark Levitt, St. Paul, MN (US)

(73) Assignee: Ecolab, Inc., St. Paul, MN (US)

( * ) Notice: Subject to any disclaimer, the term of this patent is extended or adjusted under 35 U.S.C. 154(b) by 159 days.

(21) Appl. No.: 10/267,603

(22) Filed: Oct. 9, 2002

(65) Prior Publication Data

US 2004/0072715 A1 Apr. 15, 2004

(51) Int. Cl.[7] ..... C11D 17/00

(52) U.S. Cl. ..... 510/403; 510/218; 510/421; 510/435; 510/445; 510/470

(58) Field of Search ..... 510/403, 435, 510/445, 470, 405, 421, 463, 218, 417

(56) References Cited

U.S. PATENT DOCUMENTS

| | | | |
|---|---|---|---|
| 2,674,619 | A | 4/1954 | Lundsted |
| 2,677,700 | A | 5/1954 | Jackson et al. |
| 2,903,486 | A | 9/1959 | Brown et al. |
| 3,048,548 | A | 8/1962 | Martin et al. |
| 3,326,803 | A | 6/1967 | Kelly et al. |
| 3,334,147 | A | 8/1967 | Brunelle et al. |
| 3,382,178 | A | 5/1968 | Lissant et al. |
| 3,442,242 | A | 5/1969 | Laskey et al. |
| 3,664,961 | A | 5/1972 | Norris |
| 3,929,678 | A | 12/1975 | Laughlin et al. |
| 4,260,528 | A | 4/1981 | Fox et al. |
| 4,426,362 | A | 1/1984 | Copeland et al. |
| 4,565,647 | A | 1/1986 | Lienado |
| 4,618,914 | A | 10/1986 | Sato et al. |
| 4,782,901 | A | 11/1988 | Phelps et al. |
| 4,826,661 | A | 5/1989 | Copeland et al. |
| 4,830,773 | A | 5/1989 | Olson |
| 4,890,305 | A | 12/1989 | Devries |
| 5,364,551 | A | 11/1994 | Lentsch et al. |
| 5,407,700 | A | 4/1995 | Man et al. |
| 5,589,099 | A | 12/1996 | Baum |
| 5,597,793 | A | 1/1997 | Besse et al. |
| 6,268,324 | B1 | 7/2001 | Besse et al. |
| 6,331,518 | B2 | 12/2001 | Hemm et al. |
| 6,440,915 | B2 | 8/2002 | Radar et al. |

FOREIGN PATENT DOCUMENTS

| | | |
|---|---|---|
| EP | 0 025 268 | 12/1987 |
| WO | WO 95/18213 | 7/1995 |
| WO | WO 01/68794 | 9/2001 |
| WO | WO 02/077149 | 10/2002 |

*Primary Examiner*—Necholus Ogden
(74) *Attorney, Agent, or Firm*—Crompton Seager & Tufte LLC

(57) ABSTRACT

Methods of the invention include: (a) providing a solid composition that includes; a rheology modifier, a solidifying agent, and a surfactant; (b) providing a solvent with a first viscosity; and dissolving a portion of the solid composition with the solvent forming a use solution with a second predetermined viscosity, wherein the second predetermined viscosity is greater than the first viscosity.

40 Claims, No Drawings

SOLID COMPOSITION WITH RHEOLOGY MODIFIER

BACKGROUND OF THE INVENTION

The invention relates to solid compositions that include rheology modifiers and, more particularly, to solid compositions that upon dilution form a thick use solution.

Cleaning compositions have been used for many years to remove stubborn soil or solids from a variety of surfaces. Thickeners have been used to increase the viscosity of cleaning compositions to reduce airborne mist by increasing viscosity and resultant particle size; aid in forming thick stable foam that can cling to vertical surfaces; aid in suspending particles within the cleaning composition; and aid in forming thick solutions with vertical cling. These properties also aid in increasing the time the cleaning composition is in contact with the surface to be cleaned. This increased contact time aids in the cleaning efficiency of the cleaning composition.

It is useful to provide these thickened cleaning compositions in a concentrate form where the user can merely add water or solvent to the concentrate to form the use solution. However, concentrating these cleaning compositions is difficult. When these cleaning compositions have been concentrated, the thickeners in the cleaning compositions often form a stable gel that is not dilutable.

There remains a need, therefore, for concentrated cleaning compositions that upon dilution form a thick use solution.

DETAILED DESCRIPTION

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The term "halo" and "halogen" refer to chloro, bromo, fluoro, and iodo.

Compositions

The compositions of the invention include: (a) a rheology modifier; (b) a solidiflying agent; and (c) a functional agent. When the rheology modifier is present in the solid composition in an effective amount, a use solution can be formed having a viscosity greater than the solvent used as the diluent.

Rheology Modifier

The compositions of the invention can include a rheology modifier. The rheology modifier may provide the following to the compositions of the invention: increase the viscosity of the compositions; increase the particle size of liquid use solutions when dispensed through a spray nozzle; provide the use solutions with vertical cling to surfaces; provide particle suspension within the use solutions; or reduce evaporation rate of the use solutions.

The rheology modifier may provide a use composition that is pseudo plastic, in other words the use composition or material when left undisturbed (in a shear mode), retains a high viscosity. However, when sheared, the viscosity of the material is substantially but reversibly reduced. After the shear action is removed, the viscosity returns. These properties permit the application of the material through a spray head. When sprayed through a nozzle, the material undergoes shear as it is drawn up a feed tube into a spray head under the influence of pressure and is sheared by the action of a pump in a pump action sprayer. In either case, the viscosity can drop to a point such that substantial quantities of the material can be applied using the spray devices used to apply the material to a soiled surface. However, once the material comes to rest on a soiled surface, the materials can regain high viscosity to ensure that the material remains in place on the soil. Preferably, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact between substantial quantities of the film of the material with the soil for at least a minute, preferably five minutes or more.

Thickeners or rheology modifiers include polymers or natural polymers or gums derived from plant or animal sources. Such materials may be polysaccharides such as large polysaccharide molecules having substantial thickening capacity. Thickeners or rheology modifiers include clays also.

A substantially soluble organic thickener can be used to provide pseudo plasticity to the use compositions of the invention. The thickeners can have some proportion of water solubility to promote easy removability. Examples of soluble organic thickeners for the aqueous compositions of the invention comprise carboxylated vinyl polymers such as polyacrylic acids and sodium salts thereof (available under the Acusol tradename from Rohm & Haas Co.), ethoxylated cellulose, polyacrylamide thickeners, cross-linked polyacrylate (a "Carbomer available from B.F Goodrich under the tradename "Carbopol"), xanthan compositions, sodium alginate and algin products, hydroxypropyl cellulose, hydroxyethyl cellulose, and other similar aqueous thickeners that have some substantial proportion of water solubility. Thickeners for use in the alkaline composition include xanthan thickeners sold by the Kelco Division of Merck under the tradenames KELTROL, KELZAN AR, KELZAN D35, KELZAN S, KELZAN XZ, and others. Such xanthan polymers are preferred due to their high water solubility, and great thickening power. Thickener for use in acid compositions include xanthan, polyvinyl alcohol thickeners, such as, fully hydrolyzed (greater than 98.5 mol % acetate replaced with the —OH function). Thickeners for alkaline cleaners include xanthan gum derivatives. Xanthan is an extracellular polysaccharide of xanthomonas campestras. Xanthan may be made by fermentation based on corn sugar or other corn sweetener by-products. Xanthan comprises a poly beta-(1-4)-D-Glucopyranosyl backbone chain, similar to that found in cellulose. Aqueous dispersions of xanthan gum and its derivatives exhibit novel and remarkable rheological properties. Low concentrations of the gum have relatively high viscosity which permit it economical use and application. Xanthan gum solutions exhibit high pseudo plasticity, i.e. over a wide range of concentrations, rapid shear thinning occurs that is generally understood to be instantaneously reversible. Non-sheared materials have viscosity that appears to be independent of the pH and independent of temperature over wide ranges. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which patent is incorporated by reference herein. Suitable crosslinking agents for xanthan materials include metal cations such as Al+3, Fe+3, Sb+3, Zr+4 and other transition metals, etc. Known organic crosslinking agents can also be used. A preferred crosslinked xanthan is KELZAN AR, a product of Kelco, a division of Merck Incorporated. KELZAN AR is a crosslinked xanthan that provides a pseudo plastic use solution that can produce large particle size mist or aerosol when sprayed. Diutan (available from C.P. Kelco Co.), a polysaccharide molecule may also be used as the rheology modifier.

As will be apparent to those skilled in the art, the above-listed rheology modifiers are merely illustrative and various other rheology modifiers meeting the criteria set out above may also be used in the practice of the invention.

The rheology modifier may be present in the composition from at least 0.1 wt % or 0.1 to 30 wt % or 0.1 to 20 wt % or 0.5 to 10 wt % based on the total weight of rheology modifier, solidifying agent, and functional agent.

Solidifying Agent

A solidifying agent (binding or hardening agent), as used in the present method and compositions, is a compound or system of compounds, organic or inorganic, that significantly contributes to the uniform solidification of the composition. Preferably, the hardening agents are compatible with the functional agent and rheology modifier of the composition, and are capable of providing an effective amount of hardness and/or aqueous solubility to the processed composition. The hardening agents should also be capable of forming a homogeneous matrix with the functional agent and rheology modifier when mixed and solidified to provide a uniform dissolution of the cleaning agent from the solid composition during use.

The amount of hardening agent included in the cleaning composition will vary according to the type of cleaning composition being prepared, the ingredients of the composition, the intended use of the composition, the quantity of dispensing solution applied to the solid composition over time during use, the temperature of the dispensing solution, the hardness of the dispensing solution, the physical size of the solid composition, the concentration of the other ingredients, the concentration of the cleaning agent in the composition, and other like factors. It is preferred that the amount of the hardening agent is effective to combine with the functional agent and rheology modifier of the composition to form a homogeneous mixture under continuous mixing conditions and a temperature at or below the melting temperature of the hardening agent.

It is also preferred that the hardening agent form a matrix with the functional agent and rheology modifier which will harden to a solid form under ambient temperatures of about 30 to 50 degree C., or about 35 to 45 degree C., after mixing ceases and the mixture is dispensed from the mixing system, within about 1 minute to about 3 hours, or about 2 minutes to about 2 hours, or about 5 minutes to about 1 hour. A minimal amount of heat from an external source may be applied to the mixture to facilitate processing of the mixture. It is preferred that the amount of the hardening agent included in the composition is effective to provide a hardness and desired rate of controlled solubility of the processed composition when placed in an aqueous medium to achieve a desired rate of dispensing the cleaning agent from the solidified composition during use.

A solidifying agent (binding agent) can include urea, polyethylene glycol, phosphate and carbonate hydrate, and the like. Urea has been found to bind both the rheology modifier and functional agent to provide an aqueous soluble, dispensable solid matrix. While the binding mechanism is not fully understood, urea appears to act through an inclusive mechanism with both the rheology modifier and functional agent. Inclusion as used herein generally describes the function of complexing between two or more constituents to form an adduct. Generally, the urea complex has two compounds that form a crystalline material. Urea will form inclusion complexes with hydrocarbons, alcohols, fatty acids, fatty esters, polyoxyalkylene polymers such as polyethylene glycols and other compounds. The inclusion complexes have been described as host-guest relation, where urea is the host, and it wrap itself around the guest molecule.

The solid compositions of the invention can comprise up to about 50% by weight urea. The solid composition can comprise about 10 to 45 wt % urea. The compositions can have a minimum of about 10% by weight urea. The solid compositions, for reasons of economy, desired hardness and solubility, can include 15% to 40% by weight urea. The solid compositions can generally include about 20% to 30% by weight urea. Urea may be obtained from a variety of chemical suppliers, including Sohio Chemical Company, Nitrogen Chemicals Division. Urea may be available in prilled form, and any industrial grade urea may be used in the context of this invention. The particle size of the urea material before blending in the compositions of the invention, is generally between about 200 and 4000 microns.

Polyethylene glycol may be the solidifying agent. The solidification rate of cleaning compositions comprising a polyethylene glycol solidifying agent made according to the invention will vary, at least in part, according to the amount and the molecular weight of the polyethylene glycol added to the composition.

Polyethylene glycol compounds useful according to the invention include, for example, solid polyethylene glycols of the general formula $H(OCH_2—CH_2)_nOH$, where n is greater than 15, more preferably about 30 to 1700. Solid polyethylene glycols which are useful are commercially available from Union Carbide under the name CARBOWAX. Typically, the polyethylene glycol is a solid in the form of a free-flowing powder or flakes, having a molecular weight of about 1000 to 100,000, preferably having a molecular weight of at least about 1450 to 20,000, more preferably between about 1450 to about 8000. The polyethylene glycol is present at a concentration of from about 1 to 75 wt-%, preferably about 3 to 15 wt-%. Suitable polyethylene glycol compounds useful according to the invention include, for example, PEG 1450 and PEG 8000 among others.

A phosphate-carbonate hydrate or "E-Form" hydrate may be the solidifying agent. Binding Agent Composition Mole Ratios of Materials. This solidifying agent may be characterized according to the following formula (Based on Binding Agent Total Weight):

| Component | Range of Molar Equivalents |
|---|---|
| Organo-phosphonate or organo-amino-acetate sequestrant | 1 |
| Water | 5–15 |
| Alkali Metal Carbonate Monohydrate | 3–10 |

The sequestrant can be present at amounts of about 0.1 to 70 wt. %, preferably 5 to 60 wt. % of the solid block. As this material solidifies, a single E-form binder composition forms to bind and solidify the functional and thickener components. A portion of the ingredients associate to form the binder while the balance of the ingredients forms the solid block. This hydrate binder is not a simple hydrate of the carbonate component. We believe the solid detergent comprises a major proportion of carbonate monohydrate, a portion of non-hydrated (substantially anhydrous) alkali metal carbonate and the E-form binding agent composition comprising a fraction of the carbonate material, an amount of the organophosphonate and water of hydration. The E-Form hydrate complex has a melting transition of 120–160 degree C.

The solidifying or binding agent may include a carbonate salt, a sequestrant comprising an organic phosphonate or an amino acetate and water. Preferred carbonate salts comprise alkali metal carbonates such as sodium or potassium carbonate. Organic phosphonates that are useful in the E-Form hydrate of the invention include 1-hydroxyethane-1,1-diphosphonic acid, aminotrimethylene phosphonic acid, diethylenetriaminepenta(methylenephosphonic acid) and other similar organic phosphonates. The complex can alternatively comprise an aminocarboxylic acid type sequestrant in the E-Form complex. Useful aminocarboxylic acid materials include, for example, N-hydroxyethylaminodiacetic acid, an hydroxyethylenediaminetetraacetic acid, diethylenetriaminepentaacetic acid and other similar acids having an amino group with a carboxylic acid substituent. The composition includes a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. Preferably, a cleaning composition includes about 0.1–70 wt. %, preferably from about 5–60 wt. %, of a chelating/sequestering agent.

Useful aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$; aminotri(methylenephosphonic acid) $N[CH_2PO(OH)_2]_3$; aminotri(methylenephosphonate); 2-hydroxyethyliminobis-(methylenephosphonic acid) $HOCH_2CH_2N[CH_2PO(OH)_2]_2$; diethylenetriaminepenta(methylenephosphonic acid) $(HO)_2POCH_2N[CH_2CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$(x=6); bis(hexamethylene)triamine(pentamethylenephosphonic acid) $(HO_2)POCH_2N[(CH_2)_6N[CH_2PO(OH)_2]_2]_2$; and phosphorus acid $H_3PO_3$. A preferred phosphonate combination is ATMP and DTPMP. A neutralized or alkaline phosphonate, or a combination of the phosphonate with an alkali source prior to being added into the mixture such that there is little or no heat or gas generated by a neutralization reaction when the phosphonate is added is preferred.

Other sequestrants are useful for only sequestering properties. Examples of condensed phosphates useful in the present composition include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

Polymeric polycarboxylates suitable for use as sequestering agents in the functional materials of the invention have pendant carboxylate (—$CO_2$) groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, Encyclopedia of Chemical Technology, Third Edition, volume 5, pages 339–366 and volume 23, pages 319–320, the disclosure of which is incorporated by reference herein.

As will be apparent to those skilled in the art, the above-listed solidifying agents are merely illustrative and various other solidifying agents meeting the criteria set out above may also be used in the practice of the invention.

The solidifying agent may be present in the composition from 1 wt % or 1 to 80 wt % or 5 to 40 wt % based on the total weight of rheology modifier, solidifying agent, and functional agent.

Functional Agent

A functional agent can be included in the solid compositions of the invention. Functional agents include, for example, builders, surfactants, oxygenated solvents, antimicrobial agents, and the like.

Builder

Builders can include, for example, chelating or sequestering agents, an alkalinity source, an acid source, and the like.

The builder may include a chelating/sequestering agent such as an aminocarboxylic acid, a condensed phosphate, a phosphonate, a polyacrylate, a glycine derivative, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. The composition may include 0.1–70 wt %, or 5–60 wt %, of a chelating/sequestering agent. An iminodisuccinate (available commercially from Bayer as IDS™) may be used as a chelating agent.

Useful aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like.

The composition may include a phosphonate such as 1-hydroxyethane-1,1-diphosphonic acid and the like.

Polymeric polycarboxylates may also be included in the composition. Those suitable for use as cleaning agents have pendant carboxylate groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. Polyaspartic acid may also be used. For a further discussion of chelating agents/sequestrants, see Kirk-Othmer, Encyclopedia of Chemical Technology, Third Edition, volume 5, pages 339–366 and volume 23, pages 319–320, the disclosure of which is incorporated by reference herein.

As will be apparent to those skilled in the art, the above-listed chelating/sequestering agents are merely illustrative and various other chelating/sequestering agents meeting the criteria set out above may also be used in the practice of the invention.

The chelating/sequestering agent may be present in the composition from 0.1 wt % or 0.1 to 75 wt % or 1 to 50 wt % based on the total weight of rheology modifier, solidifying agent, and chelating/sequestering agent.

The builder may be an alkalinity source. An alkalinity source may be provided to increase the pH of composition. The alkalinity source can be a strong base material or a source of alkalinity which can be an organic source or an inorganic source of alkalinity. For the purposes of this invention, a source of alkalinity also known as a basic material is a composition that can be added to an aqueous system and result in a pH greater than about 7. Organic sources of alkalinity are often strong nitrogen bases including, for example, ammonia, monoethanol amine, monopropanol amine, diethanol amine, dipropanol amine, triethanol amine, tripropanol amine, etc. One value of using the monoalkanol amine compounds relates to the solvent nature of the liquid amines. The use of some substantial proportion of a monoethanol amine, monopropanol amine, etc. can provide substantial alkalinity but can also provide substantial solvent power in combination with the other materials in the invention. The source of alkalinity can also comprise an inorganic alkali. The inorganic alkali content of the spray-on cleaners of the invention is preferably derived from sodium or potassium hydroxide which can be used in both liquid (about 10–60 wt % aqueous solution) or in solid (powder, flake or pellet) form. Preferably the preferred form of the alkali metal base is commercially available sodium hydroxide which can be obtained in aqueous solution at concentrations of about 50 wt % and in a variety of solid forms of varying particle size and shapes. Other inorganic alkalinity sources are soluble silicate compositions such as sodium metasilicate or soluble phosphate compositions such as trisodium phosphate. Exemplary alkalinity sources include an alkali metal silicate, hydroxide, phosphate, or carbonate.

The alkalinity source can include an alkali metal hydroxide including sodium hydroxide, potassium hydroxide, lithium hydroxide, etc. Mixtures of these hydroxide species can also be used. Alkaline metal silicates can also act as a source of alkalinity for the detergents of the invention.

The alkalinity source can include an alkali metal carbonate. Alkali metal carbonates which may be used include sodium carbonate, potassium carbonate, sodium or potassium bicarbonate or sesquicarbonate, among others. These sources of alkalinity can be used the compositions of the invention at concentrations of 0.1 wt-% to 70 wt-%, 1 wt-% to 30 wt-%, or 5 wt-% to 20 wt-%.

The builder may include an acid source. The acid source can be a strong acid or a strong acid combined with a weak acid. For the purposes of this invention, an acid material is a composition that can be added to an aqueous system and result in a pH less than about 7. Strong acids that can be used in the compositions of the invention include acids which substantially dissociate in an aqueous solution (strong acid) such as hydrochloric acid, sulfuric acid, trichloroacetic acid, trifluoroacetic acid, nitric acid and others. "Weak" organic and inorganic acids can be used in the invention as a component of the acid cleaner. Weak acids are acids in which the first dissociation step of a proton from the acid cation moiety does not proceed essentially to completion when the acid is dissolved in water at ambient temperatures at a concentration within the range useful to form the present cleaning composition. Such inorganic acids are also referred to as weak electrolytes as the term is used in the text book Quantitative Inorganic Analysis, I. M. Koltoff et al., published by McMillan Co., Third Edition, 1952, pp. 34–37. Most common commercially available weak organic and inorganic acids can be used in the invention. Examples of weak organic and inorganic acids include phosphoric acid, sulfamic acid, acetic acid, hydroxy acetic acid, citric acid, benzoic acid, tartaric acid, maleic acid, malic acid, fumaric acid and the like. Mixtures of strong acid with weak acid or mixtures of a weak organic acid and a weak inorganic acid with a strong acid can result in surprisingly increased cleaning efficiency. Such acid cleaners tend to be most effective to clean basic organic and inorganic soils. The soil most commonly cleaned using acid cleaners involves the soils resulting from the precipitation of hardness components of service water with cleaning compositions or food soils that can precipitate in the presence of calcium, magnesium, iron, manganese or other hardness components. Such soils include dairy residue, soap scum, saponified fatty acids or other marginally soluble anionic organic species that can form a soil precipitate or matrix when combined and contacted with divalent hardness components of service water.

As will be apparent to those skilled in the art, the above-listed builders are merely illustrative and various other builders meeting the criteria set out above may also be used in the practice of the invention.

The builder may be present in the composition from 0.01 wt % or 1 to 99 wt % or 5 to 50 wt % based on the total weight of rheology modifier, solidifying agent, and acid source.

Surfactant

The surfactant or surfactant admixture of the present invention can be selected from nonionic, semi-polar nonionic, anionic, cationic, amphoteric, or zwitterionic surface-active agents; or any combination thereof. The particular surfactant or surfactant mixture chosen for use in the process and products of this invention can depend on the conditions of final utility, including method of manufacture, physical product form, use pH, use temperature, foam properties, and soil type. The particular surfactant or surfactant mixture chosen for specific properties such as, for example, foaming, wetting, cleaning, defoaming, biocidial activity, and the like.

A typical listing of the classes and species of surfactants useful herein appears in U.S. Pat. No. 3,664,961 issued May 23, 1972, to Norris.

Nonionic Surfactant

Nonionic surfactants useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol® manufactured by Shell Chemical Co. and Alfonic® manufactured by Vista Chemical Co.

4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application for specialized embodiments. All of these ester moieties have one or more reactive hydrogen sites on their molecule which can undergo further acylation or ethylene oxide (alkoxide) addition to control the hydrophilicity of these substances.

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

7. The alkylphenoxypolyethoxyalkanols of U.S. Pat. No. 2,903,486 issued Sep. 8, 1959 to Brown et al. and represented by the formula:

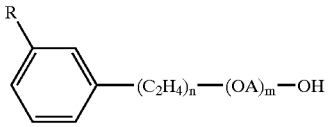

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R_2CONR_1Z$ in which: $R_1$ is H, $C_1$–$C_4$ hydrocarbyl, 2-hydroxy ethyl, 2-hydroxy propyl, ethoxy, propoxy group, or a mixture thereof; R2 is a $C_5$–$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$–$C_{18}$ fatty alcohols and $C_6$–$C_{18}$ mixed ethoxylated and propoxylated fatty alcohols are suitable surfactants for use in the present compositions, particularly those that are water soluble. Suitable ethoxylated fatty alcohols include the $C_{10}$–$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$–$C_4$ alkyl, $C_1$–$C_4$ hydroxyalkyl, or $—(C_2H_4O)_xH$, where x is in the range of from 1 to 3.

The treatise Nonionic Surfactants, edited by Schick, M. J., Vol. 1 of the Surfactant Science Series, Marcel Dekker, Inc., New York, 1983 is an excellent reference on the wide variety of nonionic compounds. A typical listing of nonionic classes, and species of these surfactants, is given in U.S. Pat. No. 3,929,678 issued to Laughlin and Heuring on Dec. 30, 1975.

Semi-Polar Nonionic Surfactants

The semi-polar type of nonionic surface active agents are another class of nonionic surfactant useful in compositions of the present invention. Generally, semi-polar nonionics are high foamers and foam stabilizers. The semi-polar nonionic surfactants include the amine oxides, phosphine oxides, sulfoxides and their alkoxylated derivatives.

13. Amine oxides are tertiary amine oxides corresponding to the general formula:

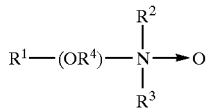

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1–3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

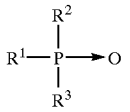

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis (hydroxymethyl)tetradecylphosphine oxide. Semi-polar nonionic surfactants useful herein also include the water soluble sulfoxide compounds which have the structure:

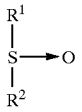

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

As is well understood, anionics are excellent detersive surfactants and are therefore, favored additions to heavy duty detergent compositions. Generally, anionics have high foam profiles. Further, anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major known chemical classes and additional sub-groups, which are described in "Surfactant Encyclopedia", Cosmetics & Toiletries, Vol. 104 (2) 71–86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11–13 total carbon atoms, although more carbons atoms (e.g., up to 16) can be present.

Other anionic detergents suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule. Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

A variety of such surfactants are also generally disclosed in U.S. Pat. No. 3,929,678, issued Dec. 30, 1975 to Laughlin, et al.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure $R_nX^+Y^-$ and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

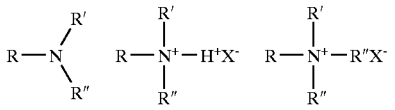

in which, R represents a long alkyl chain, R', R", and R'" may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four known major classes and additional sub-groups, which are described in "Surfactant Encyclopedia", Cosmetics & Toiletries, Vol. 104 (2) 86–96 (1989). The first class, includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

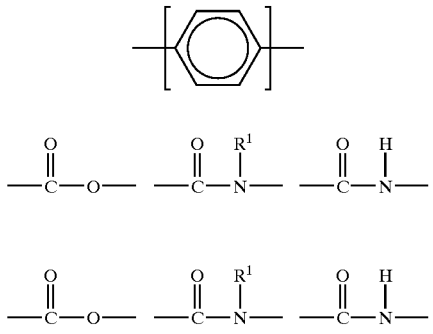

an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one R2 in a molecule being benzyl, and x is a number from 0 to 11, preferably from 0 to 6. The remainder of any carbon atom positions on the Y group are filled by hydrogens.

Y is can be a group including, but not limited to:

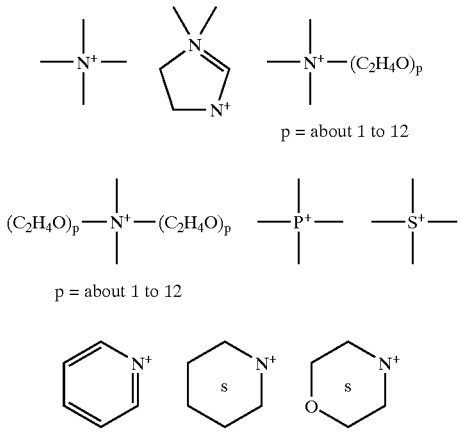

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two known major classes, which are described in "Surfactant Encyclopedia" Cosmetics & Toiletries, Vol. 104 (2) 69–71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by known methods. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives generally have the general formula:

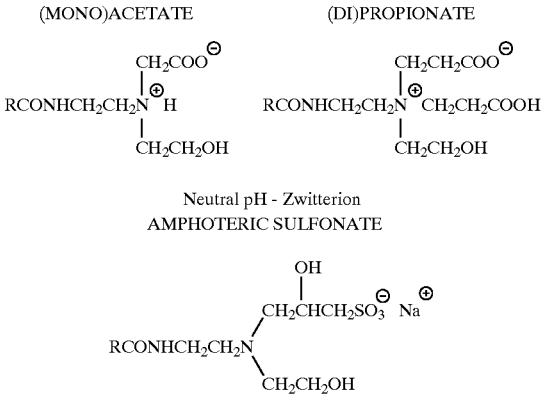

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxypropionate, Cocoamphoglycinate, Cocoamphocarboxyglycinate, Cocoamphopropyl-sulfonate, and Cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which $R=C_8$–$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In these R is preferably an acyclic hydrophobic group containing from about 8 to about 18 carbon atoms, and M is a cation to neutralize the charge of the anion.

A typical listing of amphoteric classes, and species of these surfactants, is given in U.S. Pat. No. 3,929,678 issued to Laughlin and Heuring on Dec. 30, 1975.

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

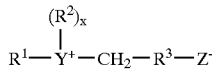

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl) sulfonio]-propane-1-phosphate; 3-[P,P-dimethyl-P-dodecylphosphonio]-propane-1-phosphonate; and S[N,N-di (3-hydroxypropyl)-N-hexadecylammonio]-2-hydroxypentane-1-sulfate. The alkyl groups contained in said detergent surfactants can be straight or branched and saturated or unsaturated.

The zwitterionic surfactant suitable for use in the present compositions includes a betaine of the general structure:

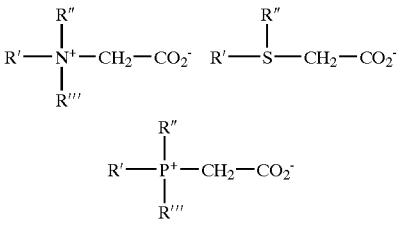

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $R(R^1)_2N^+R^2SO^{3-}$, in which R is a $C_6$-$C_{18}$ hydrocarbyl group, each $R^1$ is typically independently $C_1$–$C_3$ alkyl, e.g. methyl, and $R^2$ is a $C_1$-$C_6$ hydrocarbyl group, e.g. a $C_1$–$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975.

As will be apparent to those skilled in the art, the above-listed surfactants are merely illustrative and various other surfactants meeting the criteria set out above may also be used in the practice of the invention.

The surfactant may be present in the composition from 0.01 wt % or 1 to 70 wt % or 10 to 60 wt % based on the total weight of rheology modifier, solidifying agent, and surfactant.

Oxygenated Solvent

The compositions of the invention can contain a compatible oxygenated solvent. Oxygenated solvents include lower alkanols, lower alkyl ethers, and lower alkyl glycol ethers. These materials are colorless liquids with mild pleasant odors, are excellent solvents and coupling agents and may be miscible with aqueous use compositions of the invention. Examples of useful solvents include methanol, ethanol, propanol, isopropanol and butanol, isobutanol, ethylene glycol, diethylene glycol, triethylene glycol, propylene glycol, dipropylene glycol, mixed ethylene-propylene glycol ethers. The glycol ethers include lower alkyl ($C_{1-8}$ alkyl) ethers including propylene glycol methyl ether, propylene glycol butyl ether, propylene glycol propyl ether, dipropylene glycol methyl ether, dipropylene glycol butyl ether, tripropylene glycol methyl ether, ethylene glycol butyl ether, diethylene glycol methyl ether, diethylene glycol butyl ether, ethylene glycol dimethyl ether, ethylene glycol monobutyl ether, and others. The solvent capacity of the cleaners can be augmented by using monoalkanol amines.

As will be apparent to those skilled in the art, the above-listed solvents are merely illustrative and various other solvents meeting the criteria set out above may also be used in the practice of the invention.

The solvent may be present in the composition from 0.01 wt % or 1 to 99 wt % or 5 to 50 wt % based on the total weight of rheology modifier, solidifying agent, and solvent.

Antimicrobial Agent

Antimicrobial agents also known as sanitizing agents are chemical compositions that can be used to prevent or reduce microbial contamination and deterioration of material systems, surfaces, ect. Generally, these materials fall in specific classes including phenolics, halogen compounds, quaternary ammonium compounds, metal derivatives, amines, alkanol amines, nitro derivatives, analides, organosulfur and sulfur-nitrogen compounds, protonated fatty acids and miscellaneous compounds. The given antimicrobial agent depending on chemical composition and concentration may simply limit further proliferation of numbers of the microbe or may destroy all or a substantial proportion of the microbial population. The terms "microbes" and "microorganisms" typically refer primarily to bacteria and fungus microorganisms. In use, the antimicrobial agents are formed into a solid functional material that when diluted and dispensed using an aqueous stream forms an aqueous disinfectant or sanitizer composition that can be contacted with a variety of surfaces resulting in prevention of growth or the killing of a substantial proportion of the microbial population. A five fold reduction of the microbial population results in a sanitizer composition. Common antimicrobial agents include phenolic antimicrobials such as pentachlorophenol, orthophenylphenol. Halogen containing antibacterial agents include sodium trichloroisocyanurate, iodine-poly (vinylpyrolidinonen) complexes, bromine compounds such as 2-bromo-2-nitropropane-1,3-diol quaternary antimicrobial agents such as benzalconium chloride, cetylpyridiniumchloride, amine and nitro containing antimicrobial compositions such as hexahydro-1,3,5-tris(2-hydroxyethyl)-s-triazine, dithiocarbamates such as sodium dimethyldithiocarbamate, and a variety of other materials known in the art for their microbial properties.

As will be apparent to those skilled in the art, the above-listed antimicrobial agents are merely illustrative and various other antimicrobial agents meeting the criteria set out above may also be used in the practice of the invention.

The antimicrobial agent may be present in the composition from 0.01 wt % or 1 to 99 wt % or 5 to 50 wt % based on the total weight of rheology modifier, solidifying agent, and antimicrobial agent.

Diluent

The diluent can be any solvent capable of dissolving the solid composition of the invention. The diluent can be aqueous or organic.

Other Additives

The compositions may include bleach, enzymes, enzyme stabilizing system, secondary hardening agent or solubility modifier, defoamer, anti-redeposition agent, a threshold agent or system, aesthetic enhancing agent (i.e. dye, perfume, ect.) and the like. Adjuvants and other additive ingredients will vary according to the type of composition being manufactured and can be included in the compositions in any amount.

Bleach includes bleaching compounds capable of liberating an active halogen species, such as $Cl_2$, $Br_2$, —$OCl^-$ and/or —$OBr^-$, under conditions typically encountered during the cleansing process. Suitable bleaching agents include, for example, chlorine-containing compounds such as a chlorine, a hypochlorite, chloramine. Halogen-releasing compounds may include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A bleach may or may not possess antimicrobial activity as described above. A cleaning composition may include an effective amount of a bleaching agent, such as 0.1–10 wt %, or 1–6 wt %.

Enzymes

The composition of the invention may includes one or more enzymes, which can provide desirable activity for removal of protein-based, carbohydrate-based, or triglyceride-based stains from substrates; for cleaning, destaining, and sanitizing presoaks, such as presoaks for flatware, cups and bowls, and pots and pans; presoaks for medical and dental instruments; or presoaks for meat cutting equipment; for machine warewashing; for laundry and textile cleaning and destaining; for carpet cleaning and destaining; for cleaning-in-place and destaining-in-place; for cleaning and destaining food processing surfaces and equipment; for drain cleaning; presoaks for cleaning; and the like. Enzymes may act by degrading or altering one or more types of soil residues encountered on a surface or textile thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes may include a protease, an amylase, a lipase, a gluconase, a cellulase, a peroxidase, or a mixture thereof of any suitable origin, such as vegetable, animal, bacterial, fungal or yeast origin. Selections are influenced by factors such as pH-activity and/or stability optima, thermostability, and stability to active detergents, builders and the like. In this respect bacterial or fungal enzymes may be preferred, such as bacterial amylases and proteases, and fungal cellulases. Preferably the enzyme may be a protease, a lipase, an amylase, or a combination thereof. Enzyme may be present in the composition from at least 0.01 wt %, or 0.01 to 2 wt %.

Enzyme Stabilizing System

The composition of the invention may include an enzyme stabilizing system. The enzyme stabilizing system can include a boric acid salt, such as an alkali metal borate or amine (e.g. an alkanolamine) borate, or an alkali metal borate, or potassium borate. The enzyme stabilizing system can also include other ingredients to stabilize certain enzymes or to enhance or maintain the effect of the boric acid salt.

For example, the cleaning composition of the invention can include a water soluble source of calcium and/or magnesium ions. Calcium ions are generally more effective than magnesium ions and are preferred herein if only one type of cation is being used. Cleaning and/or stabilized enzyme cleaning compositions, especially liquids, may include 1 to 30, 2 to 20, or 8 to 12 millimoles of calcium ion per liter of finished composition, though variation is possible depending on factors including the multiplicity, type and levels of enzymes incorporated. Water-soluble calcium or magnesium salts may be employed, including for example calcium chloride, calcium hydroxide, calcium formate, calcium malate, calcium maleate, calcium hydroxide and calcium acetate; more generally, calcium sulfate or magnesium salts corresponding to the listed calcium salts may be used. Further increased levels of calcium and/or magnesium may of course be useful, for example for promoting the grease-cutting action of certain types of surfactant.

Stabilizing systems of certain cleaning compositions, for example warewashing stabilized enzyme cleaning compositions, may further include 0 to 10%, or 0.01% to 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during warewashing, can be relatively large; accordingly, enzyme stability to chlorine in-use can be problematic.

Suitable chlorine scavenger anions are known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used.

Detergent Fillers

A composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, starch, sugars, and the like. Inorganic or phosphate-containing detergent builders may include alkali metal, ammonium and alkanolammonium salts of polyphosphates (e.g. tripolyphosphates, pyrophosphates, and glassy polymeric meta-phosphates). Non-phosphate builders may also be used. A detergent filler may be included in an amount of 1–20 wt %, or 3–15 wt %.

Defoaming Agents

A minor but effective amount of a defoaming agent for reducing the stability of foam may also be included in the compositions. The cleaning composition can include 0.01–5 wt % of a defoaming agent, or 0.01–3 wt %.

Examples of defoaming agents include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-redeposition Agents

The composition may include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and the like. The composition may include 0.5–10 wt %, or 1–5 wt %, of an anti-redeposition agent.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Divalent Ion

The compositions of the invention may contain a divalent ion, selected from calcium and magnesium ions, at a level of from 0.05% to 5% by weight, or from 0.1% to 1% by weight, or 0.25% by weight of the composition. The divalent ion can be, for example, calcium or magnesium. The calcium ions can, for example, be added as a chloride, hydroxide, oxide, formate, acetate, nitrate salt.

The compositions of the invention may also contain additional typically nonactive materials, with respect to cleaning properties, generally found in liquid cleaning compositions in conventional usages.

The compositions can be diluted with aqueous and/or non aqueous materials to form a use solution of any strength depending on the application. The compositions of the invention may be in the form of a solid, liquid, gel, paste, structured liquid, and the like. The compositions and diluted use solutions may be useful as, for example, detergents for surface cleaning, laundry, warewashing, vehicle care, sanitizing, ect.

Processing of the Composition

The mixing system provides for continuous mixing of the ingredients at high shear to form a substantially homogeneous semi-solid mixture in which the ingredients are distributed throughout the mass. The mixing system includes means for mixing the ingredients and to provide shear effective for maintaining the mixture at a flowable consistency such that the mixture can be stirred, mixed, agitated, blended, poured, extruded, and/or molded in conventional industrial mixing and/or shearing equipment of the type suitable for continuous processing and uniform distribution of ingredients in a mixture. The viscosity of the mixture during processing may be about 1,000 to 1,000,000 cps (about 1 to 1,000 Pa·s), or about 5,000 to 200,000 cps (about 5 to 200 Pa·s). The mixing system may be a continuous flow mixer, as for example, a Teledyne continuous processor, a Beardsley Piper continuous mixer, or a single- or twin-screw extruder, with a twin-screw extruder, as for example, a multiple section Buhler Miag twin-screw extruder.

Generally, the mixture is processed at a temperature lower than the melting temperature of the ingredients of the composition, preferably about 1 to 90 degree C. lower, or about 5 to 20 degree C. lower. Although minimal or no external heat may be applied to the mixture during processing, it can be appreciated that the temperature achieved by the mixture may become elevated during processing due to variances in processing conditions, and/or by an exothermic reaction between ingredients. Optionally, the temperature of the mixture may be increased, for example at the inlets or outlets of the mixing system, by applying heat from an external source to achieve a temperature of about 50 to 150 degree C., or about 55 to 70 degree C., to facilitate processing of the mixture.

In general, the composition is processed at a pressure of about 5 to 150 psig (about 34 to 1034 kPa), or about 10 to 30 psig (about 70 to 210 kPa). The pressure may be increased up to about 30 to 6000 psig (about 210 kPa to 41 MPa) to maintain fluidity of the mixture during processing, to provide a force effective to urge the mixture through the mixer and discharge port, and the like.

An ingredient may be in the form of a liquid or solid such as a dry particulate, and may be added to the mixture separately or as part of a premix with one or more other ingredient, as for example, the rheology modifier, functional agent, and solidifying agent, and the like. One or more premixes may be added to the mixture.

An aqueous medium may be included in the mixture as desired, in a minor but effective amount to maintain the mixture at a desired viscosity during processing, and to provide the processed composition and final product with the desired amount of firmness and cohesion during discharge and hardening. The aqueous medium may be included in the mixture as a separate ingredient, or as part of a liquid ingredient or premix.

The ingredients are mixed together at high shear to form a substantially homogenous consistency wherein the ingredients are distributed substantially evenly throughout the mass. The mixture is then discharged from the mixing system by casting into a mold or other container or by extruding the mixture. Preferably, the mixture is cast or extruded into a mold or other packaging system. The temperature of the mixture when discharged from the mixing system may be sufficiently low to enable the mixture to be cast or extruded directly into a packaging system without first cooling the mixture. Preferably, the mixture at the point of discharge is at about ambient temperature, about 30 to 50 degree C., or about 35 to 45 degree C. The composition is then allowed to harden to a solid form that may range from a low density, sponge-like, malleable, caulky consistency to a high density, fused solid, concrete-like block.

In a preferred method according to the invention, the mixing system is a twin-screw extruder which houses two adjacent parallel rotating screws designed to co-rotate and intermesh, the extruder having multiple barrel sections and a discharge port through which the mixture is extruded. The extruder may include, for example, one or more feed or conveying sections for receiving and moving the ingredients, a compression section, mixing sections with varying temperature, pressure and shear, a die section, and the like. Suitable twin-screw extruders can be obtained commercially and include for example, Buhler Miag Model No. 62 mm, Buhler Miag, Plymouth, Minn. USA.

Extrusion conditions such as screw configuration, screw pitch, screw speed, temperature and pressure of the barrel sections, shear, throughput rate of the mixture, water content, die hole diameter, ingredient feed rate, and the like, may be varied as desired in a barrel section to achieve effective processing of ingredients to form a substantially homogeneous liquid or semi-solid mixture in which the ingredients are distributed evenly throughout.

The extruder has a high shear screw configuration and screw conditions such as pitch, flight (forward or reverse) and speed effective to achieve high shear processing of the ingredients to a homogenous mixture. Preferably, the screw includes a series of elements for conveying, mixing, kneading, compressing, discharging, and the like, arranged to mix the ingredients at high shear and convey the mixture through the extruder by the action of the screw within the barrel section. The screw element may be a conveyor-type screw, a paddle design, a metering screw, and the like. A preferred screw speed is about 20 to 300 rpm, or about 40 to 150 rpm.

Optionally, heating and cooling devices may be mounted adjacent the extruder to apply or remove heat in order to obtain a desired temperature profile in the extruder. For example, an external source of heat may be applied to one or more barrel sections of the extruder, such as the ingredient inlet section, the final outlet section, and the like, to increase fluidity of the mixture during processing through a section or from one section to another, or at the final barrel section through the discharge port. Preferably, the temperature of the mixture during processing including at the discharge port, is maintained at or below the melting temperature of the ingredients, preferably at about 50 to 200 degree C.

In the extruder, the action of the rotating screw or screws will mix the ingredients and force the mixture through the sections of the extruder with considerable pressure. Pressure may be increased up to about 6,000 psig (about 41 MPa), or up to about 5 to 150 psig (about 34 to 1034 kPa), in one or more barrel sections to maintain the mixture at a desired viscosity level or at the die to facilitate discharge of the mixture from the extruder.

The flow rate of the mixture through the extruder will vary according to the type of machine used. In general, a flow rate is maintained to achieve a residence time of the mixture within the extruder effective to provide substantially complete mixing of the ingredients to a homogenous mixture, and to maintain the mixture at a fluid consistency effective for continuous mixing and eventual extrusion from the mixture without premature hardening.

When processing of the ingredients is complete, the mixture may be discharged from the extruder through the discharge port, preferably a die. The pressure may also be increased at the discharge port to facilitate extrusion of the mixture, to alter the appearance of the extrudate, for example, to expand it, to make it smoother or grainier in texture as desired, and the like.

The cast or extruded composition eventually hardens due, at least in part, to cooling and/or the chemical reaction of the ingredients. The solidification process may last from a few minutes to about 2 to 3 hours, depending, for example, on the size of the cast or extruded composition, the ingredients of the composition, the temperature of the composition, and other like factors. Preferably, the cast or extruded composition "sets up" or begins to harden to a solid form within 30 seconds to about 3 hours, or within about 1 minute to about 2 hours and or within about 1 minute to about 1 hour.

Dispensing the Solid Compositions

It is preferred that a solid block cleaning composition made according to the present invention is dispensed from a spray-type dispenser such as those disclosed in U.S. Pat. Nos. 4,826,661, 4,690,305, 4,687,121, and 4,426,362, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use.

The solid compositions of the invention may be compositions can be diluted with a solvent to produce a use solution. Choosing the composition of the solid composition allows for customizing the particular physical properties of the resultant use solutions. For example, choosing the amount of rheology modifier in the solid composition allows the user to predetermine the viscosity of the resultant use solution. The user can choose the particle size of use solution that is sprayed through a nozzle based on the amount of rheology modifier placed in the solid composition. The viscosity of the use solution can be 30 cps, 50 cps, 100 cps or more greater than the viscosity of the diluent. The median particle size of the use solution sprayed through a nozzle can be 30 microns, 40 microns, 50 microns, 100 microns, 200 microns or more. Diluent sprayed through the nozzle can have a median particle size less than 20 microns. The use solutions of the invention have a reduced misting or aerosol formation as compared use solutions prepared from concentrates not including rheology modifiers.

Vertical cling of the resultant use solution can be chosen based on the amount of rheology modifier placed in the solid composition. Evaporation rate of the use solution can be predetermined based on the amount of rheology modifier placed in the solid composition. Particle suspension within the use solution can be predetermined based on the amount of rheology modifier placed in the solid composition. Other functional agents as described above can be placed in the solid composition to predetermine the physical properties of the resultant use solution.

The solid composition of the invention may also be applied to a soiled surface directly or diluted with a solvent to form a use solution and applied to the soiled surface. The solid composition or use solution can include an effective amount of surfactant or other additives described above to remove the soil from the surface.

The soil can be organic, inorganic or a microorganism. Organic soil includes carbon based matter such as, for example, oil, grease, food, soap scum, hard water scale, and the like. Inorganic soil includes, for example, salt deposits, rust, and the like. Microorganisms include, for example, virus, bacteria, and the like.

EXAMPLES

A comparative example of forming a concentrate including a rheology modifier, xanthan is formed by combining 99.5 wt % water and 0.5 wt % xanthan gum. This comparative example has a viscosity of 300 cps.

A second comparative example of forming a concentrate including a rheology modifier, xanthan is formed by combining 95 wt % water and 5 wt % xanthan gum. This comparative example formed a non-dilutable gel, thus a viscosity measurement was not attainable. This comparative example illustrates that forming a concentrate with a rheology modifier such as xanthan is not practical since inclusion of a rheology modifier at amounts greater than 5% forms a non-dilutable gel.

Formulations were created by combining the components in the amounts listed in Table 1 below. The values are wt %, based on the total weight of the components listed for each formulation, further functional and other additives can be added to the formulations below.

TABLE 1

| | Formulations | | | | | | | |
|---|---|---|---|---|---|---|---|---|
| | A | B | C | D | E | F | G | H |
| Polyethylene Glycol | 25 | 25 | 40 | 35 | | 25 | 25 | 25 |
| Urea | | | | | 15 | | | |
| Xanthan | 10 | 10 | 10 | 10 | 10 | | | |
| Hydroxyethyl Cellulose | | | | | | 25 | 1 | |
| Na—EDTA | 65 | | | | | | | |
| Sodium Laurel Ether Sulfate | | 65 | | | 70 | 50 | 74 | 74 |
| Glycol Ether | | | 50 | | | | | |
| Quanternary Ammonium | | | | 55 | | | | |
| Water | | | | | 5 | | | |
| Polyacrylate | | | | | | | | 1 |

| Formulation I | | |
|---|---|---|
| | 30 | PEG 8000 (Polyethylene Glycol) |
| | 25 | LAS (Dodecyl Benesulfonic Acid) |
| | 1 | NaOH |
| | 25 | Dowanol Butyl Carbitol (2-(2-Ethoxyethoxy)ethanol |
| | 2 | Kelzan (Xanthan) |
| | 10 | LMA (Lauryl ethanolamide) |
| | 7 | SLES (Sodium Lauryl Ether Sulfate) |
| Total | 100 | |

Those skilled in the art will recognize that the present invention may be manifested in a variety of forms other than the specific embodiments described and contemplated herein. Accordingly, departures in form and detail may be made without departing from the scope and spirit of the present invention as described in the appended claims.

What is claimed is:

1. A method of forming use solutions having vertical cling to surfaces comprising:

a. providing a solid composition comprising;
   i. a xanthan;
   ii. a urea, polyethylene glycol, phosphate hydrate, or a carbonate hydrate; and
   iii. a surfactant;

b. providing a solvent with a first viscosity; and c. dissolving a portion of the solid composition with the solvent forming a use solution with a second predetermined viscosity, wherein the second predetermined viscosity is greater than the first viscosity.

2. The method of claim 1, wherein the second predetermined viscosity is at least 30 cps greater than the first viscosity.

3. The method of claim 1, wherein the second predetermined viscosity is at least 50 cps greater than the first viscosity.

4. The method of claim 1, further comprising spraying the use solution forming a median airborne particle size of greater than 30 $\mu$m.

5. The method of claim 1, further comprising spraying the use solution forming a median airborne particle size of greater than 70 $\mu$m.

6. The method of claim 1, further comprising spraying the use solution forming a median airborne particle size of greater than 100 $\mu$m.

7. The method of claim 1, wherein the solid composition comprises:

a. 0.1 to 30 wt % rheology modifier comprising xanthan;

b. 1 to 80 wt % solidifying agent comprising urea, polyethylene glycol, phosphate hydrate, or a carbonate hydrate; and c. 1 to 70 wt % surfactant; all based on total weight of rheology modifer, solidifying agent and surfactant.

8. The method of claim 1, wherein the solid composition comprises:

0.5 to 10 wt % rheology modifier comprising xanthan;

5 to 40 wt % solidifying agent comprising urea, polyethylene glycol, phosphate hydrate, or a carbonate hydrate; and 10 to 60 wt % surfactant; all based on total weight of rheology modifier, solidifying agent and surfactant.

9. The method of claim 1, wherein the surfactant is an anionic surfactant, nonionic surfactant cationic, surfactant, amphoteric surfactant, or mixtures thereof.

10. The method of claim 1, wherein the solid composition further comprises a detergent builder.

11. The method of claim 10, wherein the builder is a chelating agent.

12. The method of claim 10, wherein the builder is an acid source.

13. The method of claim 10, wherein the builder is an alkalinity source.

14. The method of claim 1, wherein the solid composition further comprises an oxygenated solvent.

15. The method of claim 1, wherein the oxygenated solvent is an ether, a glycol ether, an alcohol, an alcohol ether, or mixtures thereof.

16. The method of claim 1, wherein the solid composition further comprises an antimicrobial agent.

17. The method of claim 1, wherein the solid composition further comprises a bleach, a peracid, a peroxide, a halogen, or mixtures thereof.

18. The method of claim 1, wherein the solid composition further comprises an enzyme.

19. The method of claim 1, further comprising forming a stable foam from the use solution.

20. A product formed by the method of claim 1.

21. A method of forming use solutions having vertical cling to surfaces comprising:

a. providing a soiled surface;

b. providing a solid cleaning composition comprising;

i. a xanthan;

ii. a urea, polyethylene glycol, phosphate hydrate, or a carbonate hydrate; and iii. a surfactant;

c. providing a solvent with a first viscosity;

d. dissolving a portion of the solid composition with the solvent forming a use solution with a second predetermined viscosity, wherein the second predetermined viscosity is greater than the first viscosity;

e. applying the use solution to the soiled surface in an amount effective to remove the soil from the surface.

22. The method of claim 21, wherein the surface is soiled with an organic soil.

23. The method of claim 21, wherein the surface is soiled with an inorganic soil.

24. The method of claim 21, wherein the surface is soiled with a microorganism.

25. The method of claim 21, wherein the applying the use solution comprises spraying the use solution forming a median airborn particle size of greater than 30 $\mu$m.

26. The method of claim 21, wherein the applying the use solution comprises spraying the use solution forming a median airborne particle size of greater than 70 $\mu$m.

27. The method of claim 21, wherein the applying the use solution comprises spraying the use solution forming a median airborne particle size of greater than 100 $\mu$m.

28. The method of claim 21, wherein the solid composition comprises:

a. 0.1 to 30 wt % rheology modifier comprising xanthan;

b. 1 to 80 wt % solidifying agent comprising urea, polyethylene glycol, phosphate hydrate, or a carbonate hydrate; and c. 1 to 70 wt % surfactant; all based on total weight of rheology modifier, solidifying agent and surfactant.

29. The method of claim 21, wherein the solid composition comprises:

a. 0.5 to 10 wt % rheology modifier comprising xanthan;

b. 5 to 40 wt % solidifying agent comprising urea, polyethylene glycol, phosphate hydrate, or a carbonate hydrate; and c. 10 to 60 wt % surfactant; all based on total weight of rheology modifier, solidifying agent and surfactant.

30. The method of claim 21, wherein the surfactant is an anionic surfactant, nonionic surfactant, cationic surfactant, amphoteric surfactant, or mixtures thereof.

31. The method of claim 21, wherein the solid composition further comprises a builder.

32. The method of claim 31, wherein the builder is a chelating agent.

33. The method of claim 31, wherein the builder is an acid source.

34. The method of claim 31, wherein the builder is an alkalinity source.

35. The method of claim 21, wherein the solid composition further comprises an oxygenated solvent.

36. The method of claim 35, wherein the oxygenated solvent is an ether, a glycol ether, an alcohol, an alcohol ether, or mixtures thereof.

37. The method of claim 21, wherein the solid composition further comprises an antimicrobial agent.

38. The method of claim 21, wherein the solid composition further comprises a bleach, a peracid, a peroxide, a halogen, or mixture thereof.

39. The method of claim 21, wherein the solid composition further comprises an enzyme.

40. The method of claim 21, further comprising forming a stable foam from the use solution.

* * * * *